United States Patent [19]

Knapp et al.

[11] 4,179,069

[45] Dec. 18, 1979

[54] ELECTROMAGNETICALLY OPERATED FUEL INJECTION VALVE

[75] Inventors: Heinrich Knapp, Leonberg; Waldemar Hans, Bamberg, both of Fed. Rep. of Germany

[73] Assignee: Robert Bosch GmbH, Stuttgart, Fed. Rep. of Germany

[21] Appl. No.: 900,231

[22] Filed: Apr. 26, 1978

[30] Foreign Application Priority Data

Jun. 3, 1977 [DE] Fed. Rep. of Germany ..... 2725135

[51] Int. Cl.[2] ..... B05B 1/32

[52] U.S. Cl. ..... 239/125; 239/491; 239/585

[58] Field of Search ..... 239/124, 125, 126, 490, 239/491, 533.3, 584, 585

[56] References Cited

U.S. PATENT DOCUMENTS

| | | | |
|---|---|---|---|
| 2,345,402 | 3/1944 | Lubbock et al. | 239/125 |
| 3,241,768 | 3/1966 | Croft | 239/585 X |
| 3,351,288 | 11/1967 | Perr | 239/533.3 X |
| 3,434,667 | 3/1969 | Chmura | 239/584 X |
| 3,589,610 | 6/1971 | Wahlin et al. | 239/125 |
| 3,830,429 | 8/1974 | Hiemer et al. | 239/125 X |

*Primary Examiner*—Johnny D. Cherry

*Attorney, Agent, or Firm*—Frishauf, Holtz, Goodman & Woodward

[57] ABSTRACT

To maintain the pressure with which fuel is injected from a fuel injection valve uniform during the injection period and to provide for atomization of the injected fuel by delivering the fuel through a nozzle adjacent a swirl chamber from a valve in which a continuous fluid flow is maintained from an inlet opening to a drain opening, an auxiliary valve is located adjacent the nozzle and coupled to the nozzle opening member, typically a needle valve cone, to interrupt return or drain fluid flow so that the full pressure of fuel delivered to the swirl chamber is available during injection time and the swirl action maintained, thus atomizing fuel being injected.

10 Claims, 3 Drawing Figures

ELECTROMAGNETICALLY OPERATED FUEL INJECTION VALVE

Reference to related application, assigned to the assignee of the present application:

U.S. Ser. No. 883,452, filed Mar. 6, 1978, Maurer.

The present invention relates to a fuel injection valve, and more particularly to a fuel injection valve adapted to inject gasoline into the induction pipe or inlet manifold of an internal combustion engine at comparatively low injection pressure.

BACKGROUND AND PRIOR ART

Fuel injection valves for gasoline fuel injection systems for internal combustion engines usually operate at comparatively low injection pressure, since the fuel is injected into the induction pipe at a location behind the throttle of the internal combustion engine, so that some vacuum will be available when the engine operates. Such systems require, however, excellent distribution of the fuel within the air stream arising in the induction pipe, that is, essentially complete atomization, so that the atomized drops of fuel will be carried along by the air drawn in during the suction stroke by the pistons of the internal combustion (IC) engine and, additionally, will be uniformly supplied to the various cylinders even if the induction pipe is subdivided downstream of the injection point into branch pipes leading to the respective cylinders. To provide for atomization, it has been proposed to so construct the valve that it is formed with a swirl chamber adjacent the nozzle opening of the valve so that the fuel is sprayed into the induction pipe, operating as a plenum in a form which provides for atomization. This is particularly important in systems in which the injection pulses are short.

A swirling fuel path of fuel within the valve has been obtained by forming the valve in such a manner that fuel is continuously supplied and, unless sprayed into the injection plenum, it can flow back or drain to the source. This permits retention of swirling or rotary motion of the fuel in a centrifugal path within the swirl chamber. It has been found, however, that the accurate proportioning of fuel being injected suffers in such systems because the quantity of fuel being supplied and fuel draining changes when the injection valve opens or closes. Due to the small dimensions of the injection valves it is difficult to so shape the valves that the overall fuel flow is large with respect to the fuel being injected, and thus inaccuracies in the quantity of the fuel being injected have been observed.

THE INVENTION

It is an object to provide a fuel injection valve in which the fuel being injected can be accurately measured and determined, while permitting construction of fuel injection valves which have the advantages of valves providing for good atomization of the fuel upon injection while still permitting compact construction.

Briefly, an auxiliary valve element is provided coupled to the main valve element which exposes the nozzle to the swirl chamber. This main valve element thus is a dual function element. One function is carried out, typically, by a needle valve. The auxiliary valve element is so arranged that as a second function it interrupts fuel flow downstream from the nozzle between the fuel inlet and the drain outlet when the nozzle is open, but permits such fuel flow when the nozzle is closed.

The valve element, thus, provides for differential fuel flow, either to the nozzle or to the drain outlet. Thus, the entire operating pressure to the fuel, applied through the inlet, is available during injection time.

In accordance with a preferred feature of the invention, the fuel inlet is connected to the swirl chamber through a hydraulic throttle or choke, thus rendering the valve essentially immune against contamination and plugging due to dirt. The valve element itself can be constructed as a needle valve having a conical tip closing off the nozzle and formed with a shoulder in the rear of the cone, the shoulder bearing against a valve bearing surface formed interiorly of the valve body. The rear valve surface is spaced from the valve cone shoulder when the nozzle is closed and establishes fluid communication between the fuel inlet and fuel outlet; when the valve is open, the needle is pulled inwardly, away from the nozzle opening, and the shoulder thereon will then bear against the valve bearing surface, permitting communication from the swirl chamber to the nozzle opening but not backwardly to the valve drain outlet.

The valve has the advantage with respect to prior art valves that backflow of fuel is inhibited when the valve is open. Thus, the quantity of fuel being injected can be accurately predetermined and the entire swirl energy within the swirl chamber is available for atomization of the fuel being injected.

DRAWINGS

Illustrating a preferred example:

Figure 2:
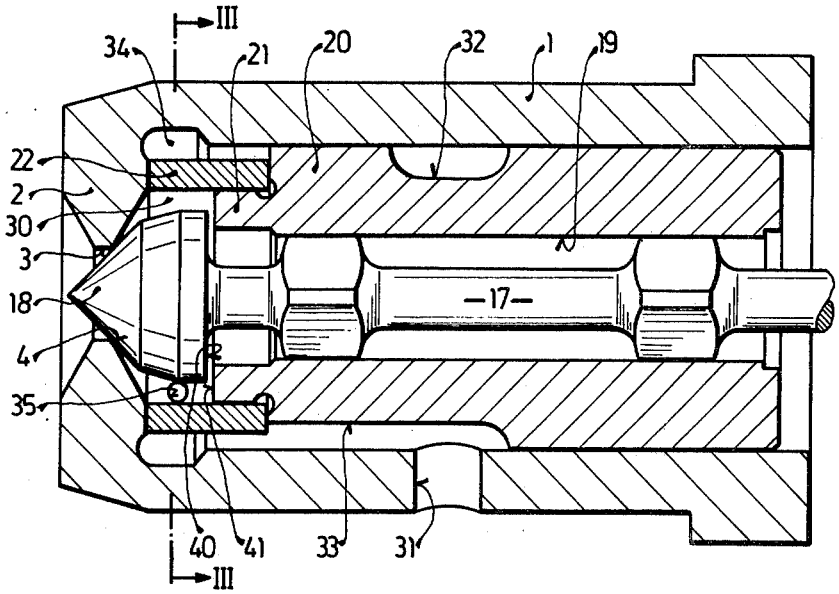
FIG. 2 is a greatly enlarged fragmentary view of the end or nozzle portion of the valve of FIG. 1.

The valve has a generally elongated body 1 having a bottom or nozzle portion 2. The nozzle portion 2 is formed with a nozzle opening 3, the inner part of which is shaped to form a valve seat 4 (FIG. 2). The body 1, which forms a housing for the entire nozzle is secured to a flange 6 with interposition of a disk 5, the flange 6 being rolled over a shoulder in the body 1. The flange 6 has a cylindrical, axial extension 7 to which a sleeve 8 of non-magnetic material is welded. The sleeve 8 and the sleeve portion 7 retain a coil 10 which is surrounded by a bell-shaped jacket 11 made of soft, magnetizable iron. A soft iron core 12 extends into the sleeve 8. Core 12 is formed with a central bore 13. The core 12 terminates at its outer end in a connecting stub 14 for a drain line for fuel. The bell 11, flange 6 and the extension 7 and core 12 form an essentially closed magnetic circuit.

Figure 1:
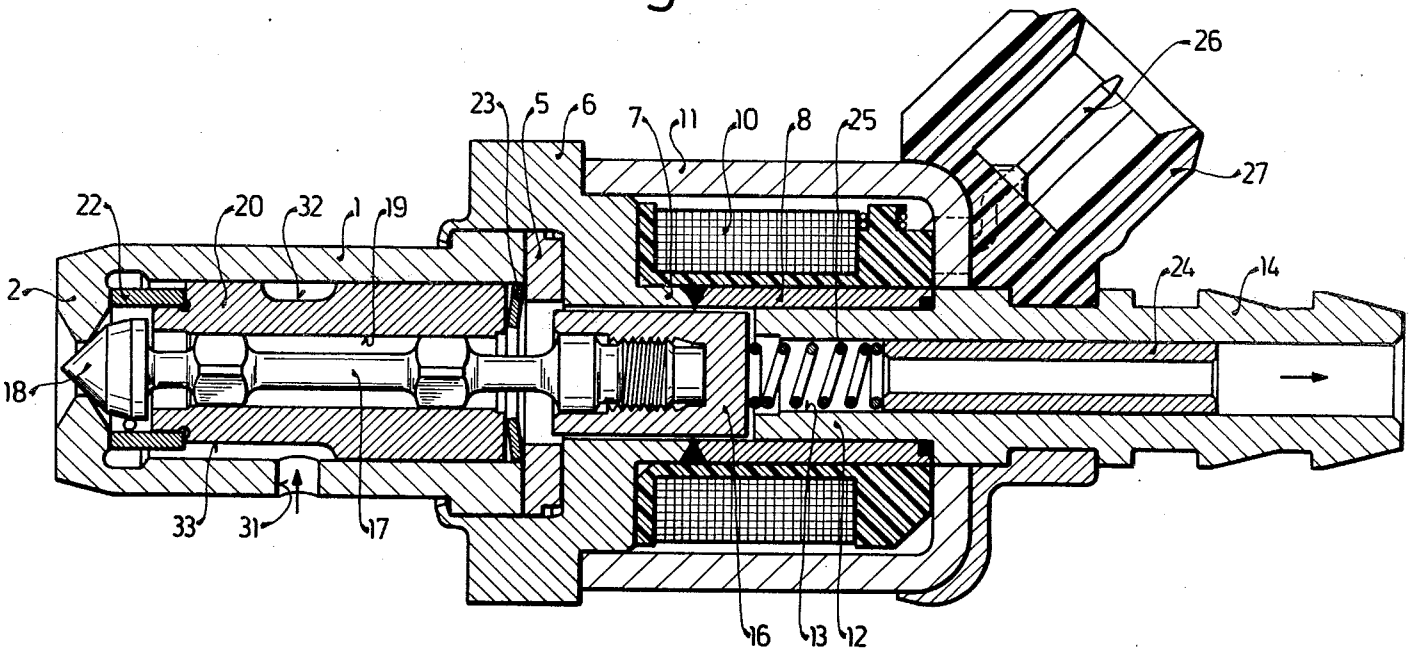
FIG. 1 is a schematic longitudinal sectional view through a valve, omitting features not material to the present invention.

An armature 16 is positioned in axial alignment with the core 12 and guided within the sleeve 8 and the cylindrical extension 7 of the flange 6 with some clearance to be freely movable therein. The armature 16 is connected to a needle valve body 17 which is formed with a conical head 18 matching the valve surface 4 to form therewith the injection valve. A needle body 17 is guided in the bore 19 of a bushing 20 (FIG. 2). Bushing 20 is secured in the body 1, for example by a press fit. The bushing 20 is formed with a ring-shaped extension 21 on which a ring 22 is pressed. The outer diameter of ring 22 is less than the inner diameter of the housing 1, so as to form a chamber 34 therewith. The ring 22, in the form of a short axial sleeve, fits against the body 2 of the housing 1. A dished disk spring 23, bearing against the disk 5, securely holds the sleeve 20 and the ring 22 in the housing if the elements 20, 22 are inserted in the housing with only an accurate fit, and prevents play of these elements within the housing, or possible loosening in operation. A bushing 24 (FIG. 1) is fitted between the armature 16 and the connecting end 14 of the valve. A spring 25 is located between the bushing 24 and the armature 16 tending to press the armature, and hence the needle valve body 17 into seated, sealing engagement at the injection opening, so that the nozzle valve formed by the cone 18 and the valve seat 4 will be closed. A coil 10, forming a solenoid, is electrically connected to connection plugs 26 located within a plastic protective plug well 27, secured to the bell 11 and to the end portion 14, as best seen in FIG. 1. The protective well 27, preferably, is a molded plastic part.

Figure 3:
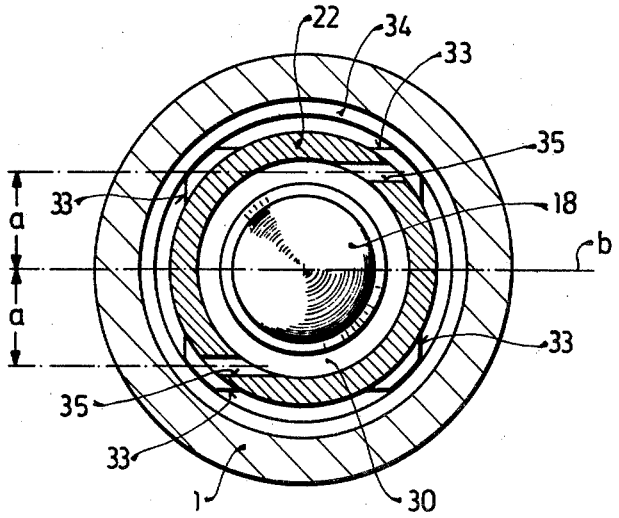
FIG. 3 is a cross section along lines III—III of FIG. 2.

The valve is formed with a swirl chamber 30 close to the injection opening 3. A fuel inlet 31 (FIGS. 1, 2) is formed laterally of the body 1, and connected to a suitable connection stub, omitted from the drawing for clarity. For example, a sleeve can be fitted over the body 1 with a hole therein and a tube connection, the hole being in alignment with the radial bore 31. The radial bore 31 is in alignment with a circular groove 32 formed in the bushing 20. The bushing 20 is additionally formed at the outer circumference with a plurality of flattened surface portions to provide longitudinal paths 33 extending to the nozzle end of the body 1. The paths 33 extend towards the chamber 34 formed between the ring 22 and the inner surface of the end portion 2 of the body 1. The ring 22 is formed with tangentially extending bores 35. The bores 35 are measuring bores and have exactly and accurately dimensioned diameters. As seen in FIG. 3, they extend parallel to each other and are offset by a distance a from a longitudinal plane b of the valve. Fuel from space 34 is conducted through the measuring bores 35 into the swirl chamber 30.

BASIC OPERATION

When the valve is closed, fuel is supplied through the pressure inlet 31 and the longitudinal slots formed by the bevels 33 to the ring space 34 between the housing 1 and the ring 22. Fuel will then flow through the measuring bores 35 into the swirl chamber 30. The fuel will flow from the swirl chamber 30 through a gap formed between the rear portion of the needle valve nozzle head 18 into the longitudinal grooves 19 and then through the space between the armature 16 and the flange 7 out through the drain outlet 14. The play or clearance between the armature 16 and the flange 7 and bushing 8, respectively, provides sufficient space for drainage or return flow of fluid. Accoringly, there will be a continuous flow of fluid from the inlet 31 to the low pressure or outlet or drain side. The valve is thus constantly flushed with fluid which is continuously rotated by centrifugal action in the swirl chamber 30.

In accordance with the present invention, an auxiliary valve is located in the swirl chamber 30 to close off the return flow of fluid when the valve 4, 18 opens, that is, when fuel is to be injected through the injection opening 3, and vice versa. The valve, thus, should function as a differential valve.

The auxiliary valve is formed immediately adjacent the outlet of the swirl chamber 30. The head 18 of the needle valve 17 is formed with a rear shoulder to function, simultaneously, as a closing body for the injection valve, that is, for the nozzle opening 3 when the nozzle is to be closed and as a closing body for the auxiliary valve when the nozzle is open. The rear of the conical end 18 of the needle valve 17 is thus shaped with a valve seat 40, in the form of a shoulder which bears against the edge 41 in the bushing 20 and cooperates with the valve body 17 to limit the upward stroke of the valve body 17.

Operation in accordance with the invention: When the valve is closed, fuel will flow in the swirl chamber 30, continuously, in rotating movement. The fuel supplied from the inlet 31 is drained through the drain connection 14. Upon energization of coil 10, the needle valve body 17 will be pulled into the magnet coil structure against the force of spring 25. This closes the backflow of fluid through the bore 19 so that the entire swirling energy is available to atomize fuel escaping through the nozzle 3. The measured amount of fuel will not change since the quantity of fuel being supplied to the swirl chamber 30 will be determined by the dimension of the bores 35 which form supply chokes or supply throttles.

The valve is essentially immune against contamination by dirt or foreign substances since the measuring zones, which determined the amount of fuel being supplied, in the light of the fuel pressure, are located interiorly of the valve, and behind the injection nozzle itself.

Various changes and modifications may be made, for example the valve body 17 and the armature 16 can be formed with radial and axial bores to additionally provide for return fluid flow axially through the inner portion of the needle valve body. The nozzle end 2 of the nozzle has been shown schematically only, and various shapes or arrangements to additionally assist in atomization of the fuel and its injection are possible, for example as described in the referenced application.

We claim:

1. Electromagnetically operated fuel injection valve to inject fuel into a plenum of an internal combustion engine comprising an elongated valve body (1, 6) having a fuel supply inlet (31) and a fuel drain outlet (14);

an operating magnet (10) located in said body;

means (33, 34, 35, 30, 19, 24) formed in said body and providing a continuous fluid path between the supply inlet and the drain outlet, said fluid path including a chamber (30) formed in the valve body and connecting means (35) leading to the chamber inclined with respect to the walls of the chamber to establish a swirling fluid flow therein;

a nozzle (3) in fluid communication with said fluid path, positioned at an end portion of the valve body and located adjacent the chamber (30);

a movable, dual valve function valve element (17, 18) coupled to said magnet and, to carry out one function, selectively, closing off said nozzle (3) and operable to open a flow path through said nozzle upon energization of the magnet;

and an auxiliary valve (40, 41) having a movable portion (40) secured to and moving with said valve element (17, 18) to carry out the second function, located downstream of the nozzle (3), and a fixed valve portion secured in said valve body, the auxiliary valve interrupting the fluid flow path between the fluid inlet (31) and the drain outlet (14) when the valve element is in a position to open the flow path through the nozzle, and permitting fluid flow between the fuel inlet and the drain outlet when the valve element (17, 18) closes off the fluid flow path through the nozzle.

2. Valve according to claim 1, wherein said connecting means (35) are accurately dimensioned bores forming fluid chokes or throttles, said connecting means being located in the fluid path from the inlet to the chamber (30) and located interiorly of said valve body.

3. Valve according to claim 1, wherein said fluid path includes a fluid choke or throttle (35).

4. Valve according to claim 1, wherein said valve element comprises a needle valve, the opening movement of which is directed in the flow direction of fluid in the fluid path from the inlet (31) to the drain outlet (14);

and the movable portion of the auxiliary valve (40, 41) includes a valve seat shoulder (40) formed on the needle valve at a side thereof remote from said nozzle (3), and structural means (20) located in the valve body (1) defining an axial duction (19) and terminating short of said valve seat shoulder (40) when the needle valve closes off said nozzle, said structural means having an end portion forming a cooperating valve seat (41) defining said fixed valve portion and engaged by said valve seat shoulder (40) when the needle valve is in open position to open communication from said chamber (30) with said nozzle and when the magnet (10) is energized.

5. Valve according to claim 4, wherein the needle valve has a conical end portion, a valve seat (4) is formed interiorly of said body (1) cooperating with said conical end portion;

and said valve seat shoulder (40) being formed on the back side of said conical end portion.

6. Valve according to claim 4, wherein the valve seat (41) formed on the structural means defines a surface of said chamber (30).

7. Valve according to claim 4, wherein said structural means (20) limits the pull-in stroke of said needle valve (17, 18).

8. Valve according to claim 1, wherein said body (1) is of essentially circular cross section and forms an elongated sleeve-like structure with a bottom (2) formed at one end, said nozzle (3) penetrating through said bottom;

an enlarged, ring-shaped space (30, 34) being located inwardly of said nozzle (3);

a ring element (22) being located in said space and subdividing said space into said chamber (30) and an outer chamber (34), the ring element (22) being formed with said connecting means (35) to provide for fluid communication between said space and the chamber in the valve body.

9. Valve according to claim 8, further including a bushing (20) located interiorly of said body (1) and formed with at least one circumferentially extending groove (32) and at least one axially extending duct (33), said at least one groove and duct forming part of said fluid path, the bushing (20) being centrally located and fitting against said ring element (22) and being formed with interior surfaces guiding the valve element;

said fluid supply inlet (31) being in communication with the at least one said groove.

10. Valve according to claim 9, wherein said valve element comprises a needle valve, the opening movement of which is directed in the flow direction of fluid in the fluid path from the inlet (31) to the drain outlet (14);

and said auxiliary valve (40, 41) includes a valve seat shoulder (40) formed on the needle valve at a side thereof remote from said nozzle (3), and structural means (20) located in the valve body (1) defining an axial duct (19) and terminating short of said valve seat shoulder (40) when the needle valve closes off said nozzle, said structural means having an end portion forming a cooperating valve seat (41) with said valve seat shoulder (40) when the needle valve is in open position to open communication from said chamber (30) with said nozzle and when the magnet (10) is energized.

* * * * *